United States Patent [19]

Proctor

[11] Patent Number: 4,914,985

[45] Date of Patent: Apr. 10, 1990

[54] RADIATOR CAP REMOVING TOOL

[76] Inventor: Walter E. Proctor, 834 Sherwood Cir., Forest Park, Ga. 30050

[21] Appl. No.: 328,300

[22] Filed: Mar. 24, 1989

[51] Int. Cl.[4] ..... B67B 7/00

[52] U.S. Cl. ..... 81/3.44; 81/176.1

[58] Field of Search ..... 81/3.44, 176.1, 176.3, 81/176.2, 3.4, 3.07

[56] References Cited

U.S. PATENT DOCUMENTS

| | | | |
|---|---|---|---|
| 3,037,408 | 6/1962 | Rives et al. | 81/176.3 |
| 3,481,227 | 12/1969 | Shook | 81/176.1 |
| 3,638,515 | 2/1972 | Lentz et al. | 81/176.2 |
| 4,458,564 | 7/1984 | Simmons | 81/3.44 |

*Primary Examiner*—Roscoe V. Parker

*Attorney, Agent, or Firm*—James B. Middleton

[57] ABSTRACT

A cap remover for removing engine radiators caps has expandable and contractible grippers to grip a cap for removal. The grippers are at the ends of the legs of a pair of tongs, and a handle having a hole allows both retraction and rotation of the grippers. Vertical movement of the handle down towards the grippers causes inward movement of the grippers, so that cap is gripped and depressed simultaneously. In this condition, the handle can be rotated to remove the cap. A shield can be mounted on the lower end of the handle above the grippers to protect the user from hot fluid.

5 Claims, 1 Drawing Sheet

RADIATOR CAP REMOVING TOOL

SUMMARY OF THE INVENTION

This invention relates generally to cap removers, and is more particularly concerned with a tool for removing an automobile radiator cap.

The present invention provides a cap remover comprising gripping means for gripping a cap without regard to protrusions on the cap. The gripping means is normally spread apart for engagement with the cap, and handle means is urged down both to close the gripping means and to provide downward force on the cap. A safety shield may be disposed between the cap and the user to direct fluid away from the user.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
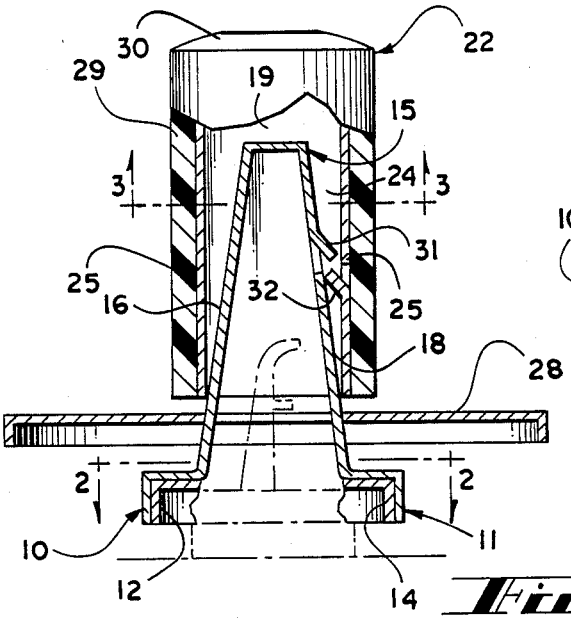
FIG. 1 is a longitudinal cross-sectional view showing a cap remover made in accordance with the present invention, and showing a radiator cap in phantom.

Referring now more particularly to the drawings, and to that embodiment of the invention here presented by way of illustration, the device shown in FIG. 1 includes opposed gripping members 10 and 11, the members 10 and 11 having linings 12 and 14 of rubber or other material for providing a good grip. The gripping members 10 and 11 are carried by a tong arrangement generally designated at 15 and having legs 16 and 18. The legs 16 and 18 are connected at their upper ends by a horizontal member 19.

With the above description in mind, it should be understood that the tongs 15 can be disposed over a radiator cap 20 with the gripping members 10 and 11 engaging opposite sides of the cap 20. The legs 16 and 18 of the tongs can be urged together, and the gripping members 10 and 11 will be forced against the cap 20 for firm engagement. It is important to note that there is space between the legs 16 and 18 of the tongs and above the cap 20. In the event the cap 20 is of the variety having a release valve therein, the lever for releasing pressure will be received within this space as is shown in phantom, and the device of the present invention will operate quite well, with no interference.

Figure 2:
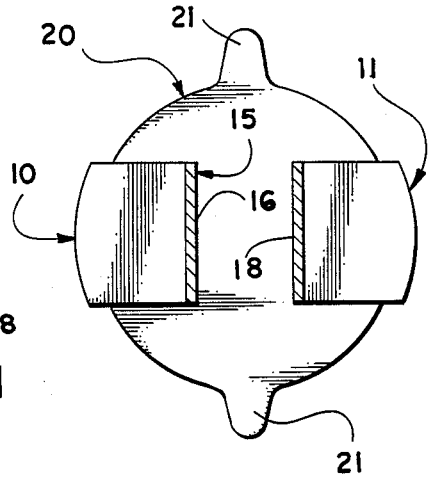
FIG. 2 is a cross-sectional view taken along the line 2—2 in FIG. 1.

Looking at FIG. 2 in conjunction with FIG. 1 it will be seen that the legs 16 and 18 of the tongs 15 are generally flat, the tongs 15 and the gripping members 10 and 11 being formed integrally. The outer ends of the gripping members are arcuate to conform somewhat to the cap 20, though it will be understood that a perfect fit is not required. So long as sufficient surface of the gripping members engages sufficient surface of the cap 20, the cap can be removed.

The cap 20 shown in FIG. 2 includes protrusions 21, but the protrusions 21 are not used. It will be understood that many caps do not have such protrusions; thus, the device of the present invention can remove a cap 20 whether or not the protrusions 21 are present.

Figure 3:
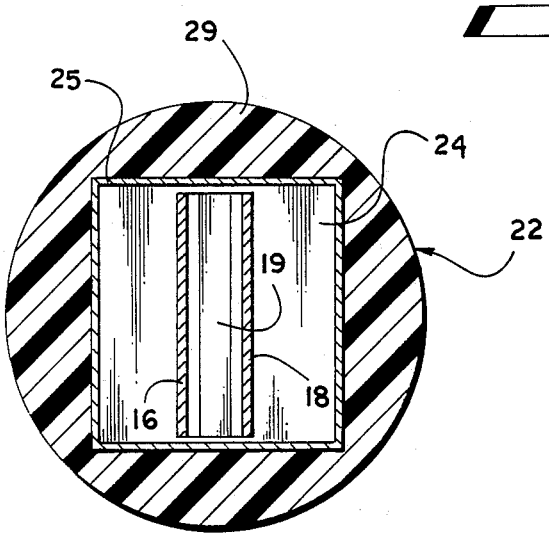
FIG. 3 is an enlarged cross-sectional view taken along the line 3—3 in FIG. 1; and, FIG. 4 is a perspective view, partially broken away, showing the device illustrated in FIG. 1.
Figure 4:
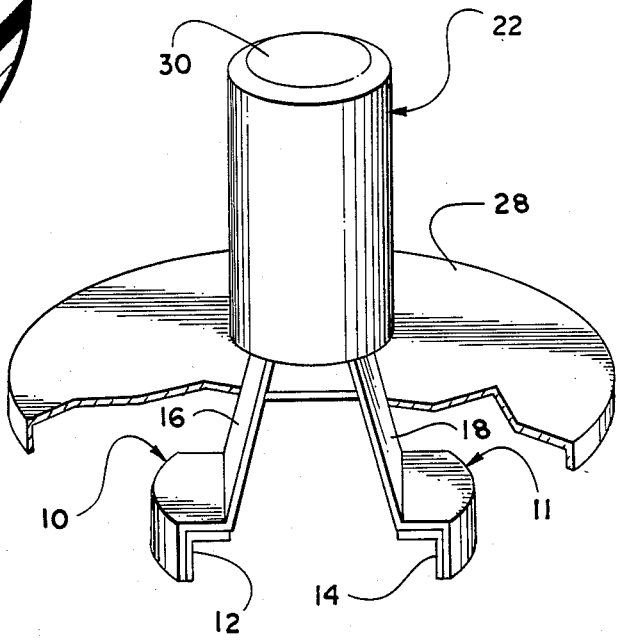

Attention is next directed to FIGS. 1 and 3 for a discussion of the handle generally designated at 22. First, it will be seen that the handle 22 includes a rectangular opening 24 for selectively receiving the tongs 15. The opening is rectangular, but it will be understood that the object is to prevent rotation of the tongs 15 with respect to the handle 22, and other mating shapes may be used if desired.

The rectangular opening 24 is formed by rigid walls 25.

As is best shown in FIG. 3, the walls 25 are covered by a plastic or rubber covering 29 to provide a comfortable and sure grip for the handle 22. While the material is illustrated as plastic, those skilled in the art will understand that numerous other materials can be used with equal success. The covering 29 can be molded onto the walls 25 if desired, or later placed and secured by an adhesive or the like. A top covering 30 completes the device, rendering the device more attractive, as well as closing the handle to prevent escape of fluid therethrough.

Between the gripping members 10 and 11 and the handle 22, there is a safety shield 28. The safety shield 28 is round and defines an opening therein. Thus, the opening in the shield 28 receives the legs 16 and 18 therethrough so the shield is appropriately disposed to protect the user. It will of course be obvious that other shapes of shields may be used, and the opening in the shield may be of any desired shape.

While the tongs 15 and the handle 22 can remain separate if desired, it is contemplated that the two members will remain together. To provide for this, there is an outwardly bent tooth 31 on the leg 18 of the tongs 15. This tooth 31 will engage a similar tooth 32, bent inwardly from the wall 25, in ratchet fashion. Thus, to assemble the two pieces, the teeth 31 and 32 will slide over each other and allow the pieces to nest together; however, when the parts move in the opposite direction, the teeth 31 and 32 will engage and limit movement. Other means for maintaining the two pieces together are also within the scope of the present invention.

With the above description in mind, the operation of the apparatus should be understandable. The tongs 15 will be inserted into the handle 22, but extending out enough that the gripping members 10 and 11 are separated sufficiently to engage the cap 20. The handle is then used to place the device on the cap 20, and the handle 22 is urged down, towards the cap 20, so the walls 25 of the opening 24 force the legs 16 and 18 of the tongs together, carrying the gripping members 10 and 11 with them. It will be seen that, the harder one pushes down, the more firmly the gripping members 10 and 11 will grip the cap 20. With the cap 20 gripped, the handle is turned to loosen the cap. When possible, the handle 22 is tipped to one side, causing the shield 28 to be between the person and any escaping fluid.

The present invention therefore provides a very simple and effective tool for removing radiator caps. The tool provides space for caps with pressure release valves, and allows use with caps having protrusions or no protrusions.

It will of course be understood by those skilled in the art that the embodiment of the invention here presented is by way of illustration only, and is meant to be in no way restrictive; therefore, numerous changes and modification may be made, and the full use of equivalents resorted to, without departing from the spirit or scope of the invention as outlined in the appended claims.

I claim:

1. A cap remover for removing automobile radiator caps, said cap remover including a plurality of gripping members selectively engageable with the edges of the cap to be removed, means for urging said gripping members towards one another for gripping said cap to be removed and simultaneously urging said cap to be removed downwardly, and means for rotating said gripping members for removal of said cap to be removed, and further including a plurality of legs, each leg of said plurality of legs carrying one of said gripping members, said legs being movable towards one another for urging said gripping members towards one another, and further including a handle defining an opening therein, said plurality of legs being receivable within said opening in said handle, the lower ends of said legs being separated by a distance greater than the width of said opening in said handle while the upper ends of said legs are received within said opening in said handle, the arrangement being such that downward movement of said handle towards said gripping members causes said lower ends of said legs to move inwardly to be received within said opening in said handle.

2. A cap remover as claimed in claim 1, said plurality of legs comprising a pair of legs in a tong arrangement, and including means for urging said lower ends of said legs apart, and resilient means on each of said gripping members for engaging said cap to be removed.

3. A cap remover as claimed in claim 2, and further including a top covering on said handle for closing said opening in said handle at the upper end of said handle.

4. A cap remover as claimed in claim 3, and including a shield disposed between said gripping members and said handle, said shield being impervious and extending laterally beyond said gripping members.

5. A cap remover as claimed in claim 4, said shield defining a central opening therein, said central opening receiving said legs of said tongs so that said shield is slidable with respect to said tongs.

* * * * *